US005106606A

United States Patent [19]

Endo et al.

[11] Patent Number: 5,106,606

[45] Date of Patent: Apr. 21, 1992

[54] FLUORINATED GRAPHITE FIBERS AND METHOD OF MANUFACTURING THEM

[75] Inventors: Morinobu Endo, Suzaka; Yoshio Ohashi, Kunitachi; Makoto Katsumata; Hidenori Yamanashi, both of Gotenba, all of Japan

[73] Assignees: Yazaki Corporation; Mitsubishi Corporation, both of Tokyo, Japan

[21] Appl. No.: 587,936

[22] Filed: Sep. 25, 1990

[30] Foreign Application Priority Data

Oct. 2, 1989 [JP] Japan ..... 1-255328
Sep. 12, 1990 [JP] Japan ..... 2-239971

[51] Int. Cl.[5] ..... D01F 9/12; D01F 9/127

[52] U.S. Cl. ..... 423/447.2; 252/503; 423/447.3

[58] Field of Search ..... 423/447.2, 447.3; 252/503

[56] References Cited

U.S. PATENT DOCUMENTS

| | | | |
|---|---|---|---|
| 4,388,227 | 6/1983 | Kalnin | 252/510 |
| 4,435,375 | 3/1984 | Tamura et al. | 423/439 |
| 4,518,575 | 5/1985 | Porter et al. | 423/447.3 |
| 4,565,649 | 1/1986 | Vogel | 423/447.2 |
| 4,604,276 | 8/1986 | Oblas et al. | 423/449 |
| 4,808,475 | 2/1989 | Matsumura et al. | 423/447.2 |
| 4,923,637 | 5/1990 | Yagi et al. | 423/447.3 |

FOREIGN PATENT DOCUMENTS

| | | | |
|---|---|---|---|
| 197314 | 11/1983 | Japan | 423/447.2 |
| 266618 | 11/1986 | Japan | 423/447.3 |
| 203870 | 8/1988 | Japan | 423/447.2 |

*Primary Examiner*—Wayne A. Langel
*Attorney, Agent, or Firm*—Armstrong, Nikaido, Marmestein, Kubovcik & Murray

[57] ABSTRACT

Fluorinated graphite fibers comprising an intercalated compound of graphite fibers, having a three-dimensional crystal structure in which carbon hexagonal network faces are substantially in parallel with the axis of the fibers, and are oriented in a coaxial manner, and fluorine, wherein the length of repeating periods in the direction of the C-axis of the crystals coexist within a range from 5 to 24 Å. The fluorinated carbon fibers are manufactured by graphitizing gas phase-grown carbon fibers obtained by thermally decomposing a hydrocarbon compound in a non-oxidative atmosphere in the presence of a catalyst supported on a substrate, or by bringing ultra-fine metal catalyst particles suspended in a high temperature zone into contact with a hydrocarbon compound, thereby obtaining graphite fibers having a three-dimensional crystal structure in which the carbon hexagonal network faces are substantially in parallel with the axis of the fibers and are oriented in a coaxial manner, and then bringing them into contact with fluorine.

3 Claims, No Drawings

FLUORINATED GRAPHITE FIBERS AND METHOD OF MANUFACTURING THEM

BACKGROUND OF THE INVENTION

1. Field of the Invention

The present invention concerns carbon fibers suitable to use in electroconductive composite materials, etc.

2. Description of the Prior Art

Since carbon fibers are light in weight and excellent in mechanical strength, as well as have satisfactory electroconductivity, they have been utilized in various application fields of use as composite materials in combination with metals, plastics or carbon materials.

By the way, since the electroconductivity of the carbon material is poor as compared with that of metal material, improvement in the conductivity of the carbon material has now been put under study, and it has been known to introduce various kinds of molecules, atoms or ions, for example nitric acid, between the layers of graphite crystals thereby obtaining an intermetallic compound with improved conductivity. Further, while it has been considered that the intercalated compound of a covalent bond type obtained by reacting graphite and fluorine exhibits insulative property, it has also been known that an electroconductive intercalated compound can be obtained by reacting flaky or powdery graphite such as natural graphite or artificial graphite and fluorine. However, since such an intercalated compound is powdery, it involves a problem that homogenous and stabilized conductivity cannot be obtained with ease and the strength is reduced when the compound is formulated into a composite material.

On the other hand, because pitch type graphite fibers or PAN type graphite fibers show not so well developed crystal structure, excellent electroconductivity cannot be obtained for the intercalated compound and, in addition, it is difficult to attain uniform dispersion thereof in the composite material Furthermore, it has also been known to use graphite fibers obtained by graphitizing gas phase grown carbon fibers having more complete crystal structure and reacting them, for example, with nitric acid, metal chlorine or bromine, even though they involve drawbacks such as that the stability is poor, to increase electric resistance with lapse of time and they bring about corrosion to the apparatus in contact therewith due to decomposition products.

OBJECT OF THE INVENTION

In view of the above, the object of the present invention is to provide graphite intercalated compound fibers which are remarkably excellent in their stability in air or heat stability, show satisfactory conductivity and can be blended easily with thermoplastic resins, etc., as well as are suitable to be used as electroconductive composite material.

SUMMARY OF THE INVENTION

The object of the present invention as described above can be attained by fluorinated graphite fibers comprising an intercalated compound of graphite fibers, having a three-dimensional crystal structure in which carbon hexagonal network faces are substantially in parallel with the axis of the fibers and are oriented in a coaxial manner, and fluorine, wherein lengths of the repeating periods in the direction of C-axis of the crystals being present coexist within a range from 5 to 24 Å.

The fluorinated graphite fibers according to the present invention can be manufactured by a method comprising graphitizing the gas phase-grown carbon fiber obtained by thermally decomposing a hydrocarbon compound in a non-oxidative atmosphere under the presence of a catalyst supported on a substrate thereby obtaining graphite fibers having a three-dimensional crystal structure in which the carbon hexagonal network faces are substantially in parallel with the axis of fibers and oriented in a coaxial manner and then bringing them into contact with fluorine.

In addition, they can be manufactured also by the method of graphitizing gas phase-grown carbon fibers obtained by bringing ultra-fine metal particle catalyst suspended in a high temperature zone into contact with a hydrocarbon compound thereby obtaining graphite fibers having a three-dimensional crystal structure in which carbon hexagonal network faces are substantially in parallel with the axis of fibers and are oriented in a coaxial manner, and then bringing them into contact with fluorine.

DETAILED DESCRIPTION OF THE INVENTION

The carbon fibers as the material for the fluorinated graphite fibers according to the present invention are obtained by using a hydrocarbon compound, for example, an aromatic hydrocarbon such as toluene, benzene or naphthalene and an aliphatic hydrocarbon, such as propane, ethane or ethylene, preferably, benzene or naphthalene, as the starting material, gasifying the above-mentioned starting material, bringing the same together with a carrier gas such as hydrogen in contact with a catalyst comprising super-fine metal particles, for example, iron, nickel, iron-nickel alloy, etc. with a grain size of 100 to 300 Å in a reaction zone at 900°–1500° C., and decomposing them.

The thus obtained carbon fibers are applied with a heat treatment at a temperature of from 1500° to 3500° C., preferably, 2500° to 3000° C., for 3 to 120 min, preferably, 30 to 60 min in an inert gas atmosphere, such as argon, and formed into graphite fibers having a three dimensional crystal structure in which the carbon hexagonal network faces are substantially in parallel with the axis of fibers and oriented in a coaxial manner. In this case, if the heat treatment temperature is lower than 1500° C., the crystal structure of carbon does not develop sufficiently. On the other hand, if the temperature exceeds 3500° C., the effect is not enhanced particularly and it is not economical. Further, if the heating treating time is shorter than 10 min, the effect of the heat treatment is not sufficient to cause great deviation in the degree of the development of the crystal structure. On the other hand, if it exceeds 120 min, no further improvement can be recognized.

The thus obtained carbon fibers may be applied with a purification treatment if necessary before or after the heat treatment for the graphitization, or they may be pulverized by using a ball mill, rotor speed mill, cutting mill or like other appropriate pulverizer. Although such pulverization is not essential, it is preferred since the easiness in forming the intercalated compound or dispersibility upon compositing with other material can be improved.

For fluorinating the thus obtained graphite fibers, there may be used a method of contacting them with a fluorine gas at a pressure not less than 100 Torr, preferably, from 300 to 1500 Torr at a temperature lower than 200° C., preferably, from −10° to +120° C. for more than 10 min, preferably, from 48 to 72 hours. In this case, for promoting the fluorination, a catalyst such as silver fluoride ma be used.

In the course of the fluorination, if the temperature of contact between the graphite fibers and the fluorine gas exceeds 200° C., fluorinated graphite of a covalent bond type is formed, thereby failing to obtain fibers of excellent electroconductivity. Further, it is necessary that the pressure of the fluorine gas is at least 100 Torr and, if it is less than that, aimed fluorinated intercalated compound cannot be obtained. Further, more than 10 minutes of time of contact between graphite fibers and fluorine is necessary and it is suitably 40 hours or longer, for example, under normal temperature and pressure although it varies depending on the reaction temperature and the pressure. However, longer reaction time is not desired, since the crystal structure deviates from the aimed range which, as a result, lowers the electroconductivity.

Under the application of the manufacturing conditions as described above, the fluorinated graphite fibers thus obtained have a composition of $C_5F$-$C_{30}F$, and the length Ic for the repeating period in the direction of the C-axis of the crystals is from 5 to 24 Å.

EXAMPLE 1

A catalyst obtained by coating a liquid prepared by dispersing particles of a metal iron catalyst with the grain size of less than 300 Å into alcohol on a mullite ceramic sheet was dispensed and deposited on a substrate, which was placed in a horizontal tubular electric furnace. Then, a gas mixture of benzene and hydrogen was introduced while controlling the temperature to 1000°-1100° C. to cause catalytic decomposition, thereby obtaining carbon fibers of 2 to 30 mm length and 5 to 50 μm diameter.

Then, the carbon fibers were placed in an electric furnace and graphitized by being held in an argon atmosphere at 2950°-3000° C. for 30 min. It was confirmed by X-ray diffraction and an electron microscope, that the thus obtained graphite fibers X had a 3-dimensional crystal structure in which carbon hexagonal network faces were in parallel with the axis of fibers and oriented in a coaxial manner, that the lattice constant $d_{002}$ was 3.36 Å, and that the crystal size Lc in the C-axis direction (002) was greater than 1000 Å.

One gram of the thus obtained graphite fibers and about 1 mg of a powdery silver fluoride were moderately mixed and charged in a nickel boat in a tubular reactor made of nickel. After evacuating the inside sufficiently, fluorine gas of high purity was introduced at room temperature and they were reacted for 72 hours while keeping the pressure at 760 Torr. Subsequently, fluorine was introduced into and adsorbed on an alumina-packed adsorption column while introducing argon into the tubular reactor and replacing the gas in the inside, to recover fluorinated graphite fibers A.

When the thus obtained fluorinated graphite fibers A were subjected to elemental analysis, it was found that the fibers had a composition of $C_{8.3}F$. Further, when the repeating period length Ic in the C-axis direction of the crystals was measured by X-ray diffractiometry, values at 9.42 Å and of 12.6 Å were obtained which showed that the product was a mixture of intercalated compounds with the stage numbers of 2 and 3.

Then, the electric resistance of the fluorinated graphite fibers A was measured by a DC 4-Point-Probe method and, further, the electric resistance was measured again, after leaving them for three months in atmospheric air, to examine their stability. In addition, high temperature stability was also examined by measuring the electric resistance 30 min and 3 hours after maintaining them at 250° C.

The results of the measurement are shown in Table 1 in comparison with the results of measurement for not-treated graphite fibers X.

TABLE 1

| | Electric Resistivity (u ohm · cm) | | | |
|---|---|---|---|---|
| | Stability at normal temperature | | Stability at high temperature* | |
| Specimen | Just after production | After 3 months | 30 min after | 3 hr after |
| A | 4.5 | no change | 4.6 | 5.0 |
| X | 60 | | 60 | |

*allowed to stand at 250° C.

EXAMPLE 2

While flowing hydrogen from below a vertical tubular electric furnace controlled to a temperature of 1000° to 1100° C., particles of a metal iron catalyst with the grain size of about 300 Å were suspended, to which a gas mixture of benzene and hydrogen was introduced from below and subjected to catalytic decomposition, to obtain carbon fibers of 0.01-1 mm length and 0.1-0.5 μm diameter. Then, the carbon fibers were pulverized by using a planetary ball mill (P-5 type, manufactured by Fliche Japan Co.) at a number of rotation of 500 rpm for 20 min.

The pulverized carbon fibers were charged into an electric furnace and graphitized while being held in an argon temperature at 2960°-3000° C. for 30 min. It was confirmed from X-ray diffraction and electron microscope that the resultant fibers had a three-dimensional crystal structure in which the hexagonal network faces were in parallel with the axis of fibers oriented in a coaxial manner, the lattice constant $d_{002}$ was from 3.37 to 3.40 Å, and the crystal size in the C-axis direction Lc(002) was 310 Å and thus they were excellent graphite fibers).

The thus obtained graphite fibers Y were fluorinated by the same procedures as those in Example 1 to recover fluorinated graphite fibers B.

When the resultant fluorinated graphite fibers B were subjected to elementary analysis, it was found that they had a composition of $C_{8.3}F$. Further, when the repeating period length Ic in the C-axis direction of the crystals was measured by X-ray diffractiometry, values of 9.42 Å and 12.6 Å were obtained to show that the product was a mixture of intercalated compounds with the number of stages 2 and 3.

One gram of the powder of such fluorinated graphite fibers was placed in a cylinder of 1 cm diameter made of insulative material which was put vertically between upper and lower brass electrodes. Then, the electric resistance between the upper and the lower electrodes was measured while compressing the powder at a pressure of up to 2 t/cm$^2$ to determine the volumic resistivity at a packing density of 1.6 g/cm$^3$. Further, the electric resistance was again measured after leaving them in atmospheric air for three months to examine their stability. Furthermore, high temperature stability was also examined by measuring the electric resistance 30 min and 3 hrs after at 250° C.

The results of measurement are shown in Table 2 in comparison with the results of the measurements for not-treated graphite fibers Y.

EXAMPLE 3

Particles of a metal iron catalyst with a grain size of about 100 Å were suspended in a vertical tubular electric furnace controlled to a temperature of 1000° to 1100° C., to which a gas mixture of benzene, hydrogen, carbon monoxide and carbon dioxide was introduced from below to cause to take place catalytic combustion, thereby obtaining carbon fibers of 0.01 to 3 mm length and 1 to 5 μm diameter. Then, the carbon fibers were pulverized in the same manner as in Example 2 and then graphitized to obtain graphite fibers Z, which were further fluorinated to obtain a powder of fluorinated graphite fibers C.

The composition and the crystal structure of the powder of the fluorianted graphite fibers C were quite identical with those of the fluorinated graphite fibers B obtained in Example 2.

Further, for the powder of the fluorinted graphite fibers C, the volumic resistivity was measured and, further, stability in the atmospheric air and stability at high temperature were also examined like those in Example 2.

The results of the measurement are shown in Table 2 in comparison with the results of measurement for not-treated graphite fibers Z.

TABLE 2

| | Electric Resistivity ($10^{-3}$ ohm · cm) | | | |
|---|---|---|---|---|
| | Stability at normal temperature | | Stability at high temperature* | |
| Specimen | Just after production | After 3 months | 30 min after | 3 hr after |
| B | 4.5 | no change | 4.5 | 5.5 |
| C | 2.2 | no change | 2.3 | 2.8 |
| Y | 20 | | 20 | |
| Z | 10 | | 10 | |

*allowed to stand at 250° C.

EXAMPLE 4

Fluorinated graphite fibers D were obtained using the graphite fibers X obtained by the same procedures as those in Example 1 and by conducting fluorination by the same procedures as those in Example 1 except for reacting for 48 hours while keeping the pressure of fluorine at 700 Torr.

When the thus obtained fluorinated graphite fibers D were subjected to elemental analysis, it was found that the fibers had a composition of $C_{20.2}F$. Further, when the repeating period length Ic in the C-axis direction of the crystals was measured by X-ray diffractiometry, values of 16.42 Å and 19.80 Å were obtained to show that the product was a mixture of intercalated compounds with stage numbers of 4 and 5.

Then, the electric resistance of the fluorinated graphite fibers D was measured by the same DC 4-Point-Probe method as in Example 1.

The results of the measurement are shown in Table 3 in comparison with the results of measurement for the fluorinated graphite fibers A and not-treated graphite fibers X.

COMPARATIVE EXAMPLE 1

Fluorinated graphite fibers E were obtained using the graphite fibers X obtained by the same procedures as those in Example 1 and by conducting fluorination by the same procedures as those in Example 1 except for reacting for 24 hours while keeping the pressure of fluorine at 760 Torr.

When the thus obtained fluorinated graphite fibers E were subjected to elemental analysis, it was found that the fibers had a composition of $C_{40.3}F$. Further, when the repeating period length Ic in the C-axis direction of the crystals was measured by X-ray diffractiometry, the structure of the graphite fibers X remained definitely and the formation of the intercalated compound having the periodical structure as defined herein could not be confirmed.

Then, the electric resistance of the fluorinated graphite fibers A was measured by the same DC 4-Point-Probe method as in Example 1 and the results ar shown together in Table 3.

EXAMPLE 5

Fluorinated graphite fibers F were obtained using the graphite fibers X obtained by the same procedures as those in Example 1 and by conducting fluorination by the same procedures as those in Example 1 except for reacting for 144 hours while keeping the pressure of fluorine at 760 Torr.

When the thus obtained fluorinated graphite fibers F were subjected to elemental analysis, it was found that the fibers had a composition of $C_{5.7}F$. Further, when the repeating period length Ic in the C-axis direction of the crystals was measured by X-ray diffractiometry, values of 5.14 Å, which was extremely intense, and of 9.38 Å, which was extremely weak, were obtained to show that most of the intercalated compound had a stage number of 1, being mixed with a small amount of stage number of 2.

Then, the electric resistance of the fluorinated graphite fibers F was measured by the same DC 4-Point-Probe method as in Example 1 and the results are shown together in Table 3.

TABLE 3

| Specimen | Electric resistivity (u cm) |
|---|---|
| A | 4.5 |
| D | 5.3 |
| E* | 45 |
| F | 8 |
| X* | 60 |

*Comparative Example

EXAMPLE 6

Fluorinated graphite fibers G were obtained using the graphite fibers Y obtained by the same procedures as those in Example 2 and by conducting fluorination by the same procedures as those in Example 4.

When the thus obtained fluorinated graphite fibers G were subjected to elemental analysis, it was found that the fibers had a composition of $C_{22.5}F$. Further, when the repeating period length Ic in the C-axis direction of the crystals was measured by X-ray diffractiometry, values of 13.6, 17.1 and 20.8 Å were obtained to show that the product was a mixture of intercalated compounds with the stage number of 3, 4 and 5.

The electric resistance of the fluorinated graphite fibers G was measured by the same powder method as in Example 2 and the volumic resistivity at a packing density of 1.6 g/cm$^3$ was shown in Table 4 in comparison with the results of the measurement for the fluorinated graphite fibers B and not-treated graphite fibers A.

EXAMPLE 7

Fluorinated graphite fibers H were obtained using the graphite fibers Y obtained by the same procedures as those in Example 2 and by conducting fluorination by the same procedures as those in Example 5.

When the thus obtained fluorinated graphite fibers F were subjected to elemental analysis, it was found that the fibers had a composition of $C_{6.3}F$. Further, when the repeating period length Ic in the C-axis direction of the crystals was measured by X-ray diffractiometry, a weak peak at 5.17 Å and strong peaks at 9.41 and 12.78 Å were obtained to show that most of the intercalated compound had a stage number of 2 and 3, being mixed with a small amount of stage number of 1.

The electric resistance of the fluorinated graphite fibers H was measured by the same powder method as in Example 2 and the results are shown together in Table 4.

EXAMPLE 8

Fluorinated graphite fibers I were obtained using the graphite fibers Z obtained by the same procedures as those in Example 3 and by conducting fluorination by the same procedures as those in Example 4.

When the thus obtained fluorinated graphite fibers I were subjected to elemental analysis, it was found that the fibers had a composition of $C_{19.8}F$. Further, when the repeating period length Ic in the C-axis direction of the crystals was measured by X-ray diffractiometry, values of 16.4 Å and 19.8 Å were obtained to show that the product was a mixture of intercalated compounds with stage numbers of 4 and 5.

Then, the electric resistance of the fluorinated graphite fibers I was measured by the same powder method as in Example 2 and the results are shown in Table 4 in comparison with the results of measurement for the fluorinated graphite fibers C and not-treated graphite fibers Z.

TABLE 4

| Specimen | Electric resistivity ($10^{-3}$ cm) |
|---|---|
| B | 4.5 |

TABLE 4-continued

| Specimen | Electric resistivity ($10^{-3}$ cm) |
|---|---|
| G | 4,9 |
| H | 4.9 |
| Y* | 20 |
| C | 2.2 |
| I | 2.4 |
| X* | 10 |

*Comparative Example

The fluorinated graphite fibers according to the present invention have a lower specific gravity than metal a higher electroconductivity than conventional carbon materials. Further they maintain higher stability as compared with conventional graphite intercalated compounds. In addition, they show satisfactory dispersibility, for example in synthetic resins, can effectively provide electroconductivity even when a small amount is used and, thus, are suitable for use in composite materials, etc.

What is claimed is:

1. Flourinated graphite fibers comprising an intercalated compound of graphite fibers, having a three-dimensional crystal structure in which carbon hexagonal network faces are substantially in parallel with the axis of the fibers and are oriented in a coaxial manner, and fluorine, wherein the length of repeating periods in the direction of the C-axis of the crystals coexist within a range from 5 to 24 Å.

2. A method of manufacturing fluorinated carbon fibers as defined in claim 1, wherein the method comprises graphitizing gas phase-grown carbon fibers obtained by thermally decomposing a hydrocarbon compound in a non-oxidative atmosphere in the effective presence of a catalyst supported on a substrate, under conditions such that graphite fibers having a three-dimensional crystal structure in which the carbon hexagonal network faces are substantially in parallel with the axis of fibers and oriented in a coaxial manner, are obtained and then bringing the graphite fibers into contact with fluorine.

3. A method of manufacturing fluorinated carbon fibers as defined in claim 1, wherein the method comprises graphitizing gas phase-grown carbon fibers obtained by bringing ultra-fine metal particle catalyst suspended in a high temperature zone into contact with a hydrocarbon compound, under conditions such that graphite fibers having a three-dimensional crystal structure in which the carbon hexagonal network faces are substantially in parallel with the axis of fibers and are oriented in a coaxial manner, are obtained and then bringing them into contact with fluorine.

* * * * *